US006474240B1

(12) United States Patent
Chemiere et al.

(10) Patent No.: US 6,474,240 B1
(45) Date of Patent: Nov. 5, 2002

(54) DEVICE AND PROCESS TO ATTACH A PRIMING SYSTEM TO THE BODY OF A GRENADE

(75) Inventors: Patrice Chemiere, Laslades (FR); Philip Fouqueau, Bourges (FR); Jean-Paul Dupuy, Bourges (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/806,227

(22) PCT Filed: Oct. 10, 2000

(86) PCT No.: PCT/FR00/02800

§ 371 (c)(1),
(2), (4) Date: Mar. 28, 2001

(87) PCT Pub. No.: WO01/29498

PCT Pub. Date: Apr. 26, 2001

(30) Foreign Application Priority Data

Oct. 18, 1999 (FR) ..... 99 13060

(51) Int. Cl.[7] ..... F42B 27/00; F42B 30/00

(52) U.S. Cl. ..... 102/487; 102/476; 102/306; 102/482

(58) Field of Search ..... 102/306–310, 102/476, 487, 482, 473, 483, 202.8, 396–397, 424

(56) References Cited

U.S. PATENT DOCUMENTS

| | | | | | |
|---|---|---|---|---|---|
| 2,562,928 | A | * | 8/1951 | Lewis | 102/483 |
| 2,696,191 | A | * | 12/1954 | Sheehan | 102/202.8 |
| 3,191,533 | A | * | 6/1965 | Hopson, III | |
| 3,705,552 | A | * | 12/1972 | Lerman | 102/487 |
| 3,913,483 | A | * | 10/1975 | Wolterman | 102/476 |
| 3,926,122 | A | | 12/1975 | Wolterman | |
| 4,014,263 | A | * | 3/1977 | Plumer | |
| H251 | H | * | 4/1987 | Field | 102/487 |
| 4,662,278 | A | * | 5/1987 | Lillios | 102/487 |
| 5,000,094 | A | * | 3/1991 | Sullivan | 102/473 |
| 5,048,419 | A | * | 9/1991 | Skowasch | |
| 5,355,801 | A | * | 10/1994 | Donahue et al. | |
| 5,355,803 | A | * | 10/1994 | Robinet et al. | 102/487 |
| 5,485,790 | A | * | 1/1996 | Hamilton | |

FOREIGN PATENT DOCUMENTS

| | | |
|---|---|---|
| GB | 578775 | 7/1946 |

* cited by examiner

*Primary Examiner*—Charles T. Jordan
*Assistant Examiner*—Lulit Semunegus
(74) *Attorney, Agent, or Firm*—Parkhurst & Wendel, L.L.P.

(57) ABSTRACT

A system for attaching a priming system onto the body of a grenade, including a support integrally fastened to the grenade body and incorporating a thin cylindrical wall whose upper edge is crimped onto the priming system.

10 Claims, 4 Drawing Sheets

DEVICE AND PROCESS TO ATTACH A PRIMING SYSTEM TO THE BODY OF A GRENADE

Figure 1:
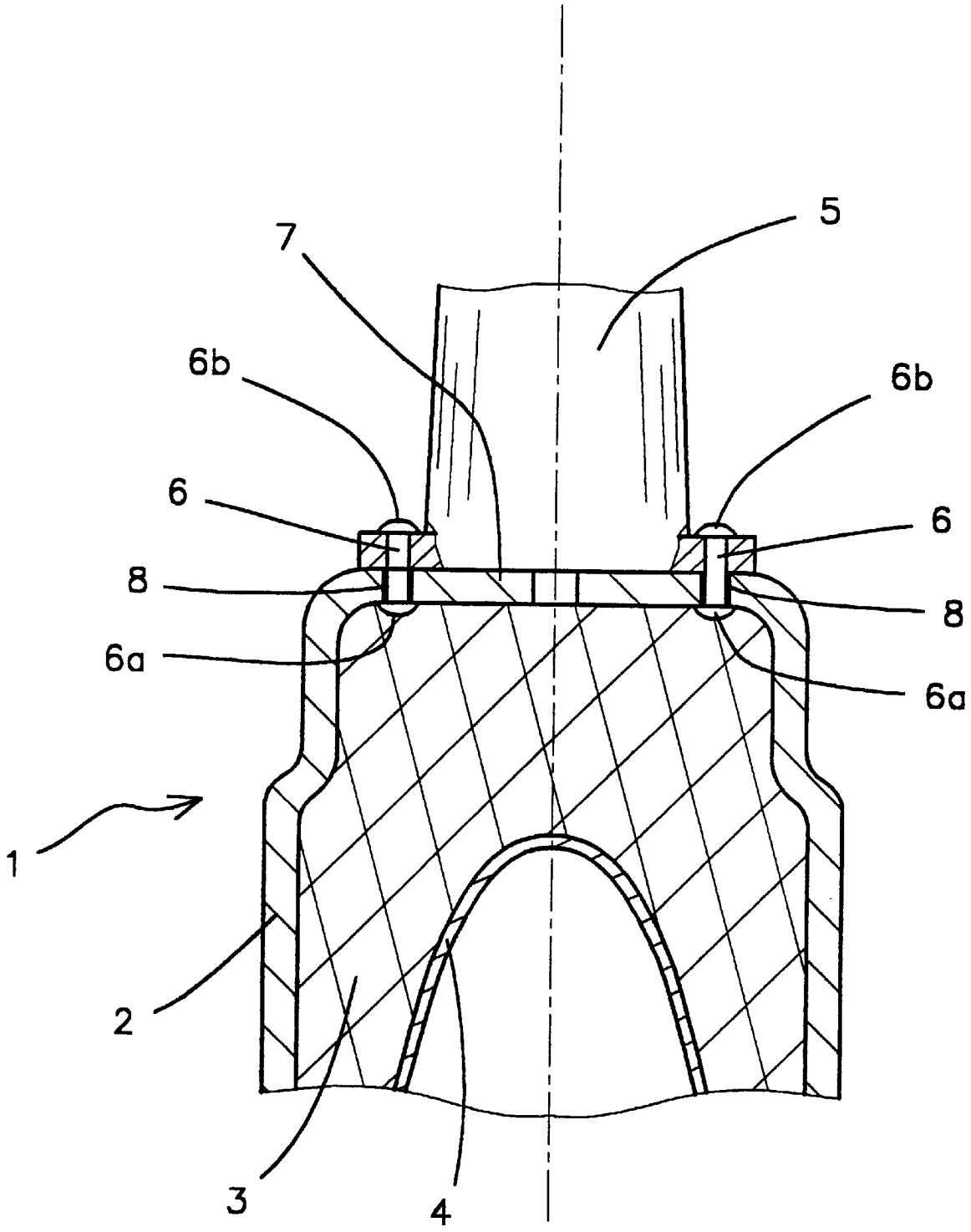

The technical scope of the present invention is that of devices allowing a priming system to be attached to the body of a grenade, and notably a shaped charge grenade intended to be carried on-board and scattered by a projectile (shell or rocket) during its trajectory.

Priming systems for such grenades are generally attached to the grenade by riveting or screwing.

U.S. Pat. No. 3,913,483 thus describes a priming system attached by riveting.

Such attachment means do not allow the priming system to be easily replaced by a new system, for example a more effective system, incorporating for example a self-destruct device.

The rivets must be cut and can therefore no longer be used to attach the new priming system.

The grenade body can therefore not be reused and the grenade must be entirely replaced.

The aim of the present invention is to supply a device to attach a priming system onto the body of a grenade that allows, reliably and economically, the subsequent replacement of the priming system.

A further subject of the invention is a process allowing a priming system and a grenade body to be easily joined together.

The process according to the invention allows such joining within the scope of the updating of a grenade store.

In fact, it allow an old priming system to be replaced by a new priming system, even if the latter is different in shape, materials and dimensions to the former priming system.

Thus, the subject of the invention is a device to attach a priming system onto the body of a grenade, such device characterised in that it is formed by a support made integral by fastening means on the grenade body, such support incorporating a thin cylindrical wall whose upper edge is crimped onto the priming system.

According to a first embodiment, the support can be constituted by a cup having a bottom wall integral with the cylindrical wall and placed pressing on an upper face of the grenade.

The cup will have, for example, at least two holes allowing the shanks integral with the grenade body to pass through.

The cup can be made integral with the shanks by welding.

According to a second embodiment, the support can be formed by a tube that is fastened by welding at an external wall of the body.

The external wall onto which the tube is fastened can incorporate a shoulder constituting an abutment for the tube.

The external wall onto which the tube is fastened can be rounded, the end of the tube in this case having a flared part and a bevel.

A further subject of the invention is a process to attach a priming system to a grenade body, such process characterised by the following steps:

- a portion of a metallic tube is cut,
- part of the external surface of a grenade body is capped by this tube portion,
- the tube portion is welded to the grenade body,
- the priming system is placed inside the tube,
- the tube is crimped onto the priming system.

A further subject of the invention is another process to attach a priming system to a grenade body, such process characterised by the following steps:

- a portion of a metallic tube is cut,
- a collar forming a crimping abutment is made at one end of the tube, before it is placed around a priming system or else after having placed it around a priming system,
- part of the external surface of a grenade body is capped by the tube carrying the priming system,
- the tube portion is welded to the grenade body.

Advantageously, when that part of the grenade body onto which the tube is applied is rounded, the tube will be slightly flared before or during its positioning onto the grenade body, this in order to enlarge the relative contact surface between the tube and the grenade body.

Welding can be made by laser.

Laser welding can be made so as to cut one end of the tube so as to arrange a bevelled edge at this end of the tube.

Figure 2:
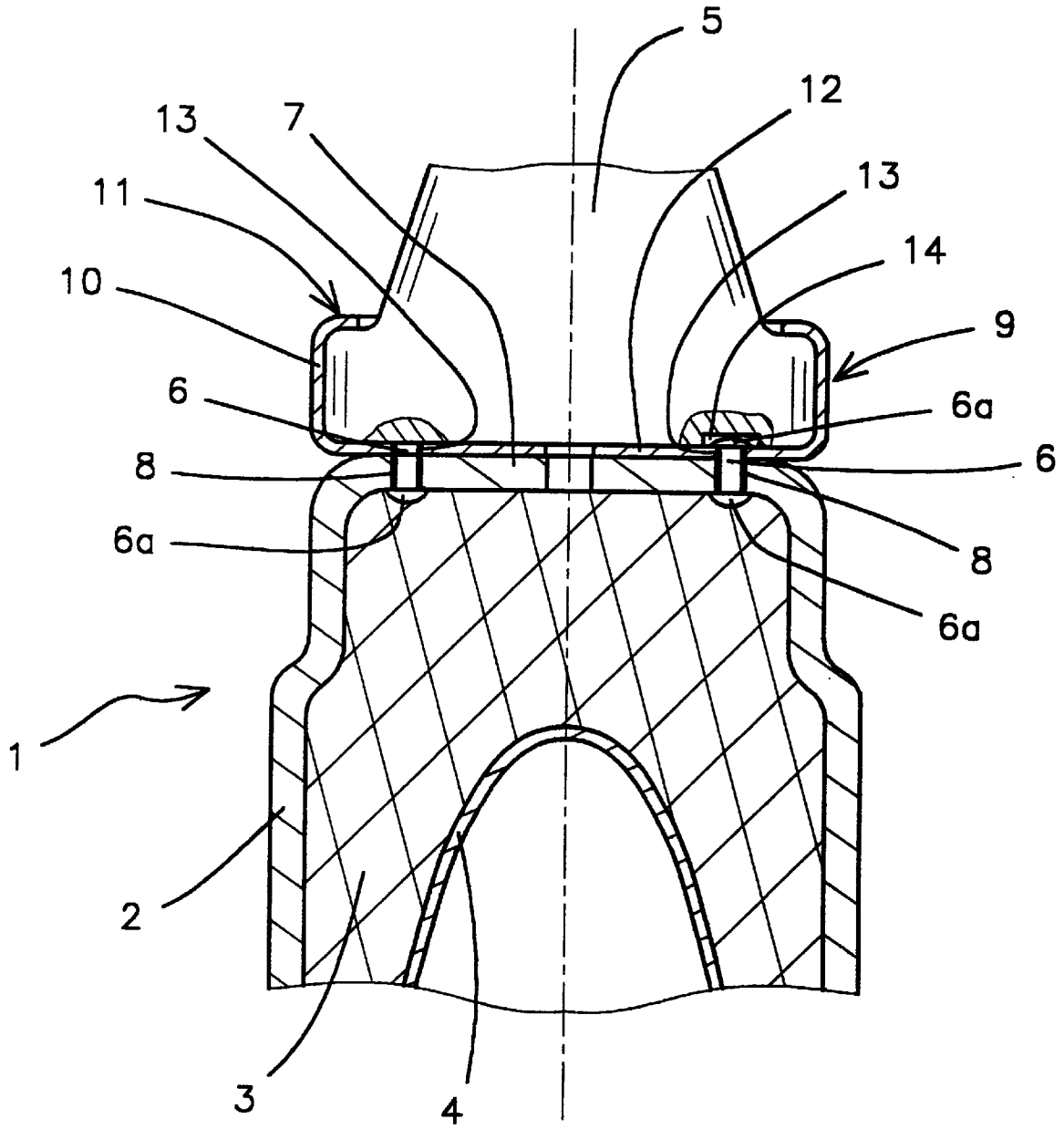
Figure 3:
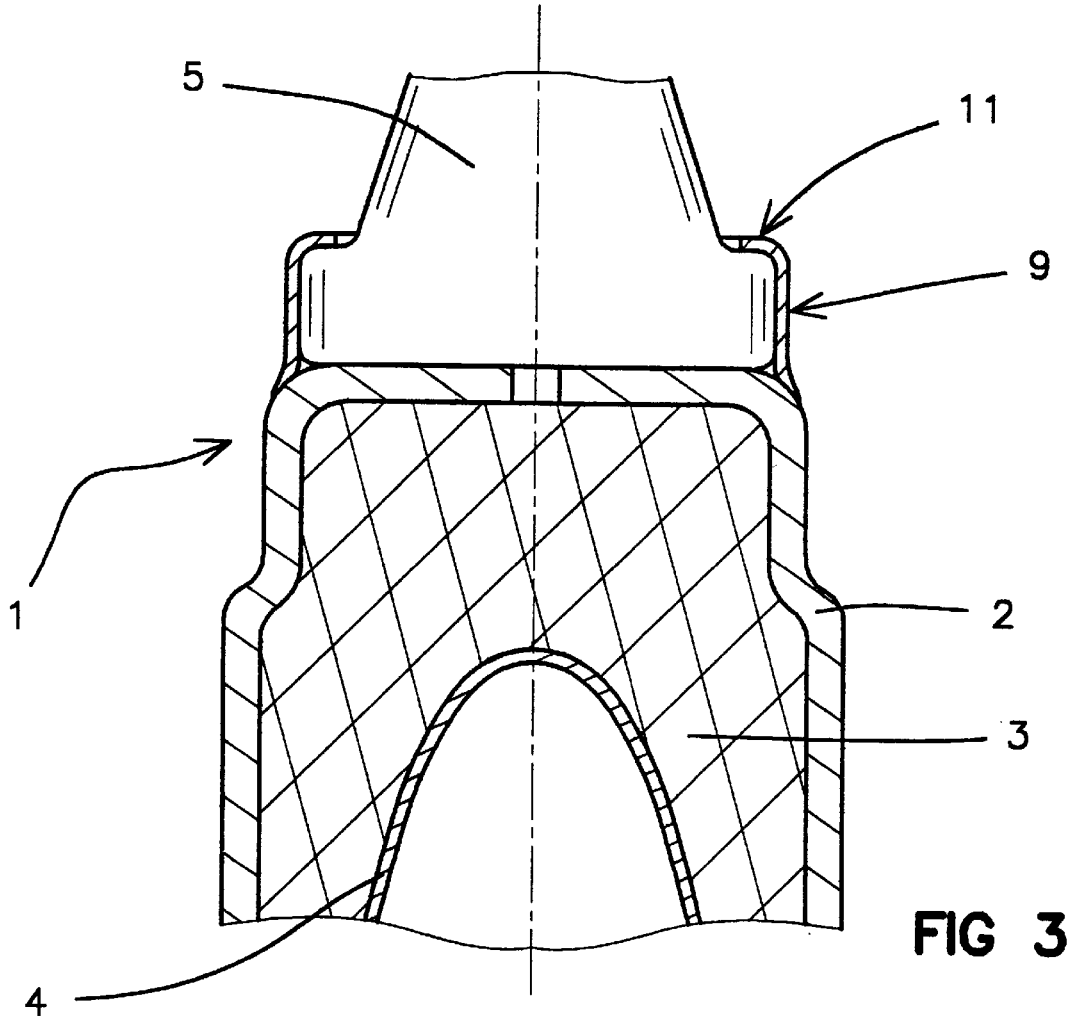
Figure 5A:
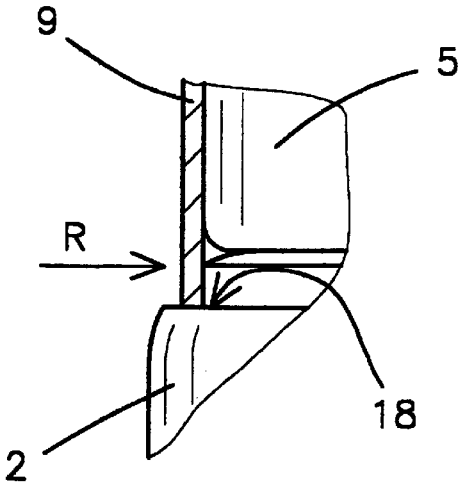
Figure 5B:
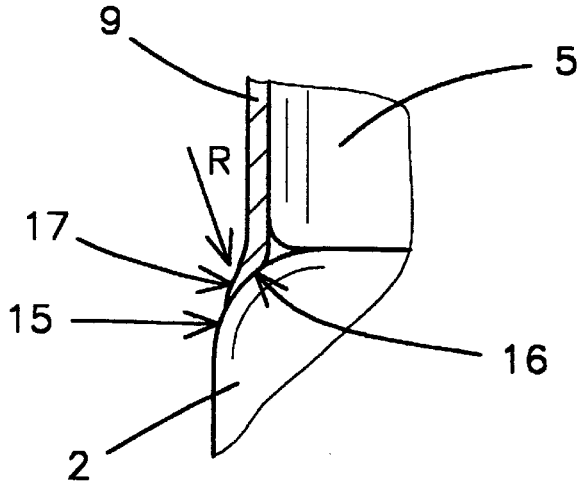
Figure 4:
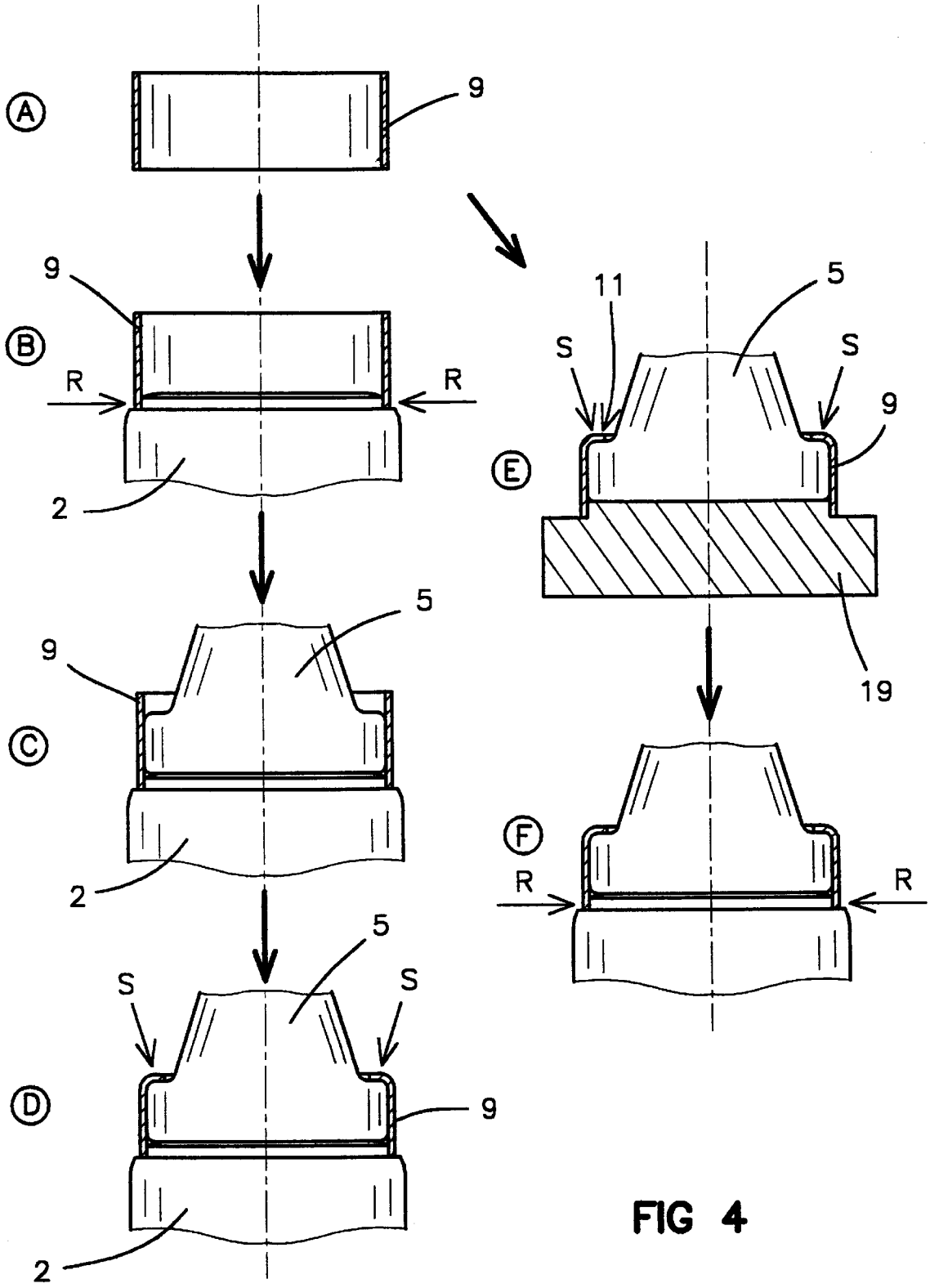

Other advantages of the invention will become apparent after reading the following description of the various embodiments, such description made in reference to the appended drawings, in which:

FIG. 1 schematically features a partial section of a grenade carrying a priming system attached by a fastening device according to prior art, FIG. 2 shows a first embodiment of a fastening device according to the invention, FIG. 3 shows a second embodiment of a fastening device according to the invention, FIG. 4 shows the different steps in the fastening process according to the invention, FIGS. 5*a* and 5*b* are two detailed views of two variant embodiments of the welding of the tube onto the grenade body.

FIG. 1 features a grenade 1 of a known type (such as described, for example, in U.S. Pat. No. 3,913,483). It incorporates a metallic body 2 that encloses an explosive charge 3 onto which a substantially conical metallic liner 4 is applied.

A priming system 5, of a known type and of which only the external profile is shown here, is attached to the body 2 of the grenade by a fastening device that comprises four rivets 6 evenly spaced angularly (here only two rivets can be seen).

The rivets 6 pass through an upper face 7 of the grenade body 2 via holes 8. The heads 6*a* of the rivets are embedded in the explosive charge 3. The deformable tails 6*b* of the rivets are applied to the priming system 5.

With this known fastening device, it is difficult for the priming system to be replaced by another more efficient priming system.

The tails 6*b* of the rivets must firstly be cut in order to retract the priming system 5. Thereafter, it is difficult for the foreshortened rivets to be used to attach another priming system. Additionally, the latter's geometry must be able to co-operate with said rivets.

It is important to note that it is impossible to replace the rivets 6 as such an operation requires the unloading of the explosive 3, which is both costly and hazardous.

FIG. 2 features a first embodiment of a fastening device according to the invention.

According to this embodiment, the priming system 5 is made integral with the grenade body 2 by means of a metallic support 9 incorporating a thing cylindrical wall 10 whose upper edge 11 is crimped onto the priming system 5.

The support 9 is constituted by a cup having a bottom wall 12 integral with the cylindrical wall 10 and placed pressing on the upper face 7 of the grenade body 2.

The cup 9 will, for example, be made of 1 mm thick buckled sheet steel.

It incorporates holes 13 allowing the passage of the shanks of rivets 6 integral with the grenade body 2.

According to a first variant, the cup 9 is joined to the body 2 by crimping the ends 6*b* of the rivets 6 onto the cup 9 (see the right-hand rivet in FIG. 2). In this case, the rivets 6 will have previously been cut at an appropriate length to allow them to be crimped onto the thin cup 9.

The cup is approximately 1 mm thick, it is thus easy to shorten the rivets usually used (that are about 10 mm long) so as to give them a dimension suitable for crimping.

It is, however, necessary for a recess 14 to be provided in the priming system 5 that avoids any interference with the tails 6*b* of the rivets.

According to a second variant (see the left-hand rivet in FIG. 2) the rivets 6 can be cut so that their ends are flush with the inside of the cup 9. Thereafter, the cup 9 will be attached by welding, for example by laser, the ends of the rivets onto the cup.

The laser welding will be carried out by heating the cup and the rivet along the circular contact line of the rivet 6 with the hole 13 in the cup 9.

In this variant, there is no interference between the rivet shanks and the priming system.

As we can see, thanks to the fastening device according to the invention, it is possible for a priming system such as that shown in FIG. 1 to be replaced by another priming system. The rivets can be reused without it being necessary to remove the explosive from the grenade body.

Additionally, the cup allows a priming system, of any shape or structure, to be attached to the grenade body. It also allow a priming system to be easily attached whose structure is made of very different materials to that of the grenade body, for example, a plastic material or zinc/aluminium alloy (alloys known under the trade name of zamak).

The device according to the invention can also be used for a new grenade. It will allow the subsequent replacement of the priming system by another system. All that is required is for the edge 11 of the cup to be de-crimped in order to dismount the priming system. A new system can be inserted in its place and the cup re-crimped.

By way of a variant, a cup 9 can be made with no holes 13 that will be joined to the upper face 7 of the grenade body 2 by bonding or else by spot heating (electric arc welding).

FIG. 3 shows a second embodiment of an attachment device according to the invention.

According to this embodiment, the support 9 is constituted by a tube that is fastened by welding at an external wall of the body 2.

FIG. 5*b* shows an enlarged view of the end of the tube 9 that is welded to the body 2. In this particular case, the external wall 15 of the body 2, upon which the tube 9 is fastened, is rounded. The end of the tube 9 has a flared part 16 and a bevelled edge 17.

The flaring 16 of the tube 9 will be carried out by using a suitable tool, for example a chuck of the required shape and onto which the tube will be applied with enough compression force to allow the tube to be deformed. It is possible for the flaring operation to be carried out directly on the grenade body 2.

According to an advantageous embodiment, the welding between the tube 9 and the body 2 will be laser welding carried out in a circular crown with the orientation R of the radiation being such that it cuts the end of the tube 9 so as to both create the weld and the end bevel 17.

The bevel avoids excessive hard-edged thicknesses from building up on the body that would put the tube 9 in danger of being ripped off when the grenades are scattered by their carrier (shell or rocket).

According to a variant embodiment (FIG. 5*a*), the external wall of the grenade body 2 has a shoulder 18 forming an abutment allowing the axial positioning of the tube 9. The tube will be attached to the body, for example, for laser welding carried out in a circular crown with an orientation R substantially perpendicular to the tube and to the external wall of the grenade body 2.

After the tube 9 has been attached to the grenade body, the priming system 5 is positioned inside the tube 9 and the upper edge 11 is crimped onto the priming system 5.

FIG. 4 summarises the different steps of the process according to the invention allowing a priming system to be attached to a grenade body.

During the first step A, a portion 9 of metallic tube, for example 1 mm thick, is cut.

During step B, part of the external surface of a grenade body 2 is capped using this tube portion, which is welded R to the grenade body 2. Welding will preferably be laser welding.

Naturally, according to the external shape of the grenade body 2, the end of the tube will perhaps be flared, as described previously with reference to FIG. 5*b*. This flaring will be carried out between steps A and B or directly on the grenade body 2.

During step C, the priming system 5 is placed inside the tube 9.

Lastly, during step D, the tube 9 is crimped onto the priming system 5.

Depending on production imperatives, the tube 9 can be given its final length from step A or can be cut to its final length after being welded to the body (step B).

According to another attachment process proposed by the invention, step A can be followed by step E during which a collar forming a crimping abutment 11 can be made at one end of the tube 9. This collar can be made as shown here after the tube has been placed around the priming system 5.

In this case, support tooling 19 will be provided that comprises a cylindrical part receiving the tube 9 and of a height corresponding to that of the part of the grenade body intended to receive the tube 9.

In this case, it is possible for the crimping collar 11 to be made directly on the priming system 5.

By way of a variant, this collar 11 can be made using appropriate tooling separate from the priming system.

At step F part of an external surface of the grenade body 2 is capped by the tube 9 carrying the priming system 5 and the portion of the tube 9 is attached to the grenade body at weld R.

Once again, welding will be laser welding.

The processes proposed by the invention can be implemented to manufacture new grenades.

They can advantageously be used to attach a new, more efficient, priming system (for example having a self-destruct system) to old grenade bodies already loaded with explosive.

In this case, the grenade bodies 2 will be prepared by detaching the old priming systems from them, for example by cutting the fastening rivets.

Thereafter, the new priming system will be attached following one or other of the processes according to the invention.

What is claimed is:

1. An attachment device for attaching a priming system (5) to the body (2) of a grenade (1), comprising:

a support (9) comprising a cup for abutting against an upper face (7) of a grenade body (2), said cup comprising a bottom wall (12) integral with a cylindrical wall (10) having an upper edge (11) for crimping to a priming system (5); and fastening means for attaching said support to a grenade body.

2. The attachment according to claim 1, wherein the cup (9) has at least two holes (13) for the passage of shanks (6) integral with a grenade body (2).

3. The attachment according to claim 2, wherein the cup (9) is integrally welded to the shanks (6).

4. An attachment device for attaching a priming system (5) to the body (2) of a grenade (1), comprising:

a support (9) comprising a cup for abutting against an upper face (7) of a grenade body (2), said cup comprising a bottom wall (12) integral with a cylindrical wall (10) having an upper edge (11) for crimping to a priming system (5) and a lower edge for welding to an external wall (15) of a grenade body (2).

5. The attachment according to claim 4, wherein the external wall (15) onto which the tube end is fastened has a shoulder (18) for abutting the tube end.

6. The attachment according to claim 4, wherein said tube end for welding comprises a flared part (16) and a bevel (17).

7. A process for attaching a priming system (5) to a grenade (1) body (2), comprising:

cutting a portion (9) of a metallic tube, rounding an end of tube portion (9), flaring (16) the rounded end of the tube (9) before or during positioning the tube end on the grenade body (2), positioning the tube portion on the external surface of a grenade body (2), welding the tube portion (9) to grenade body (2), placing a priming system (5) inside the tube portion (9), and crimping the tube portion (9) onto a priming system (5).

8. A process for attaching a priming system (5) to a grenade body (2), comprising:

cutting a portion (9) of a metallic tube, said tube portion (9) having two ends, rounding an end of tube portion (9), flaring (16) the rounded end of the tube (9), forming a crimping abutment at an opposite end of the tube portion (9), placing priming system (5) inside the tube portion (9), positioning the tube portion (9) on part of the external surface of a grenade body (2), and welding the tube portion (9) to a grenade body (2).

9. The attachment for a priming system according to claim 8, wherein welding is laser welding.

10. The attachment for a priming system according to claim 11, wherein laser welding comprises simultaneously beveling and welding one end of the tube (9) to form a welded, beveled edge (17).

* * * * *